US006910752B2

(12) United States Patent
Shoji

(10) Patent No.: US 6,910,752 B2
(45) Date of Patent: Jun. 28, 2005

(54) INK JET PRINTING APPARATUS AND METHOD FOR ADJUSTING DRIVING TIMING OF INK EJECTION

(75) Inventor: Michiharu Shoji, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 10/227,387

(22) Filed: Aug. 26, 2002

(65) Prior Publication Data

US 2003/0052933 A1 Mar. 20, 2003

(30) Foreign Application Priority Data

Aug. 27, 2001 (JP) ..... 2001-256624

(51) Int. Cl.[7] ..... B41J 29/38; B41J 21/16
(52) U.S. Cl. ..... 347/14; 400/279
(58) Field of Search ..... 347/14, 37, 5, 347/9, 19; 400/279, 124.05, 166

(56) References Cited

U.S. PATENT DOCUMENTS 5,439,301 A 8/1995 Nishizawa ..... 400/124.05
6,302,514 B1 * 10/2001 Eade et al. ..... 347/33
6,419,338 B1 * 7/2002 Ikeda ..... 347/14

FOREIGN PATENT DOCUMENTS

| | | | |
|---|---|---|---|
| EP | 0 483 371 | 5/1992 | ..... B41J/19/18 |
| EP | 0 945 277 | 9/1999 | ..... B41J/2/51 |
| EP | 0 990 531 | 4/2000 | ..... B41J/19/20 |

* cited by examiner

*Primary Examiner*—Lamson Nguyen
*Assistant Examiner*—Blaise Mouttet
(74) *Attorney, Agent, or Firm*—Fitzpatrick, Cella, Harper & Scinto

(57) ABSTRACT

The present invention provides an ink jet printing apparatus and method that can print a high-grade image without being affected by a variation in moving speed of a printing head. To accomplish this, an encoder is used which outputs a pulse each time a printing head and a printing medium are moved a specified amount relative to each other. Driving timings with which ink is ejected from the printing head are adjusted depending on the time interval between the pulses.

15 Claims, 7 Drawing Sheets

INK JET PRINTING APPARATUS AND METHOD FOR ADJUSTING DRIVING TIMING OF INK EJECTION

This application is based on Patent Application No. 2001-256624 filed Aug. 27, 2001 in Japan, the content of which is incorporated hereinto by reference.

BACKGROUD OF THE INVENTION

1. Field of the Invention

The present invention relates to an ink jet printing apparatus and method that uses a printing head capable of ejecting ink to print an image on a printing medium.

2. Description of the Related Art

Ink jet printing apparatuses are widely used as means installed in printers, facsimile machines, or copiers to print images (including characters and symbols) on printing media such as paper, thin plastic sheets (e.g., OHP film) or the like on the basis of image information.

FIG. 6 is a perspective view of an essential part of an ink jet printing apparatus. In FIG. 6, a printing medium 201 is supported by a printing medium feeding roller 202 arranged in a print area. The feeding roller 202 is driven by a sheet feeding motor 203 to transport the printing medium 201 in a sub-scanning direction indicated by an arrow α. The sheet feeding motor 203 is composed of a stepping motor or a DC motor. In recent years, the DC motor has often been used owing to its quietness or the like. In this case, a rotary encoder (not shown) is installed in the feeding roller 202 so as to control the sheet feeding motor 203 on the basis of an encoder signal obtained from the rotary encoder. One or more shafts 204 are provided in front of and parallel with the feeding roller 202. A carriage 205 is movably guided along the shafts 204, and is reciprocated in a main-scanning direction indicated by an arrow β, in response to power from a carriage motor 206 by way of belt 207. A lubricant such as grease is provided between the shafts 204 and the carriage 204 to reduce the mechanical load caused by friction or the like.

The carriage motor 206 is composed of a stepping motor or a DC motor similarly to the sheet feeding motor 203. In recent years, the DC motor is often used owing to its quietness or the like. In this case, a rotary encoder (not shown) is arranged on the carriage 205, and a linear encoder (not shown) is arranged parallel with the shafts 204. Then, on the basis of a signal obtained from this linear encoder, the carriage motor 206 is controlled. Further, on the basis of a signal obtained from this linear encoder, timings are generated with which ink is ejected from a printing head 208.

The carriage 205 as printing head moving means has the printing head 208 and a tank 209 mounted thereon, the tank 209 containing print ink. In this example, the printing head is used for printing color images and has a black ink ejecting head 208-BK, a cyan ink ejecting head 208-C, a magenta ink ejecting head 208-M, and a yellow ink ejecting head 208-Y arranged along a scanning direction of the carriage 205. Further, the carriage 205 has a tank 209-BK for black ink (Bk), a tank 209-C for cyan ink (C), a tank 209-M for magenta ink (M), and a tank 209-Y for yellow ink (Y) mounted thereon as the tank 209. These tanks supply ink to the heads for the corresponding colors. The printing head 209 is provided with an ink ejecting section on a front surface thereof. The front surface is located opposite a printing surface of the printing medium 201 at a predetermined interval (for example, 0.8 mm). The ink ejecting section has a plurality (for example, 48 or 64) of ink ejecting ports arranged in a longitudinal line along a direction crossing the scanning direction of the carriage 205.

Further, a control section (not shown) of the printing apparatus including a control circuit (CPU or ASIC) and a ROM, a RAM, and the like annexed to the control circuit, for example, receives information on print modes and print data from a controller of an external host apparatus via an interface. Then, the control section of the printing apparatus controls the printing head 208 via a head drive circuit together with drive sources of the printing apparatus such as various motors, to cause ink to be ejected through the ink ejecting section of the printing head 208 to print an image on the printing medium 201. That is, an image is printed on the printing medium 201 by alternately repeating an operation of ejecting ink from the ink ejecting section while moving the printing head 208 in the main-scanning direction and an operation of transporting the printing medium 201 in the sub-scanning direction by a predetermined amount.

FIG. 7 is a diagram illustrating the relationship between the speed at which the printing head 208 is moved and the positions at which ink droplets impact the printing medium 201.

It is assumed that the printing head 208 is mounted on the carriage 205 and is being moved at an ideal head speed V in the main scanning direction, indicated by β in the figure. In this case, when an ink droplet 303 is ejected from the printing head 208 to the printing medium 201 at an ink ejection speed Vd, it flies at a speed determined by synthesizing the vectors of the ideal head speed V and ink ejection speed Vd in a direction determined in the same manner. Then, the ink droplet 303 moves the distance d between the printing head 208 and the printing medium 201 and then impacts at an ideal impacting position 306 on the printing medium 201.

However, in order to improve print throughput, it may be desirable to perform a printing operation in all movement areas including an acceleration area, a constant speed area, and a deceleration area. Further, even in the constant speed area for the carriage 205, cockling of the motor 206 or the servo accuracy thereof may vary the moving speed of the carriage 205. As a result, the ink droplet 303 may be ejected while the moving speed (scanning speed) of the printing head 208 is varying.

If the moving speed of the printing head 208 varies in this manner, then the direction and speed of the ink droplet 303 vary to cause the impacting position on the printing medium 201 to deviate from the ideal impacting position 306. In FIG. 7, if the printing head 208 is moved at a speed Vs lower than the ideal head speed V, the ink droplet 303 flies at a speed determined by synthesizing the vectors of the speed Vs and ink ejection speed Vd in a direction determined in the same manner. As a result, in the direction β in which the printing head 208 is moved as shown in the figure, the ink droplet 303 impacts the printing medium at a position 307 located in front of the ideal impacting position 306. On the other hand, in FIG. 7, if the printing head 208 is moved at a speed Vf higher than the ideal head speed V, the ink droplet 303 flies at a speed determined by synthesizing the vectors of the speed Vf and ink ejection speed Vd in a direction determined in the same manner. As a result, in the direction β in which the printing head 208 is moved as shown in the figure, the ink droplet 303 impacts the printing medium at a position 308 located beyond the ideal impacting position 306.

Thus, when the moving speed of the printing head 208 varies, if the ink droplet 303 is ejected, the impacting position of the ink droplet 303 deviates from the ideal one. Consequently, a print image may be disturbed.

SUMMARY OF THE INVENTION

It is an object of the present invention to provide an ink jet printing apparatus and method that can print a high-grade image without being affected by a variation in moving speed of a printing head.

In the first aspect of the present invention, there is provided an ink jet printing apparatus using a printing head capable of ejecting ink and printing a printing medium by ejecting ink while moving the printing head and the printing medium relative to each other, the apparatus comprising;

an encoder that outputs a pulse each time the printing head and the printing medium are moved a specified amount relative to each other;

detecting means for detecting a time interval between the pulses;

adjusting means capable of adjusting driving timings with which the ink is ejected from the printing head;

calculating means for setting the time interval between the pulses obtained when the printing head and the printing medium are moved relative to each other with an expected maximum speed, as a reference time interval, and calculating delay time for a driving timing for the printing head depending on the magnitude of the time interval between the pulses detected by the detecting means; and control means for controlling the adjusting means depending on the delay time calculated by the calculating means.

In the second aspect of the present invention, there is provided an ink jet printing method of using a printing head capable of ejecting ink and printing a printing medium by ejecting ink while moving the printing head and the printing medium relative to each other, the method comprising the steps of:

using an encoder that outputs a pulse each time the printing head and the printing medium are moved a specified amount relative to each other;

setting a time interval between the pulses obtained when the printing head and the printing medium are moved relative to each other with an expected maximum speed, as a reference time interval, and calculating delay time for a driving timing for the printing head depending on the magnitude of the time interval between the pulses; and adjusting the driving timing with which the ink is elected from the printing head, depending on the delay time.

The present invention enables ink to always impact a printing medium at an ideal position by adjusting ink ejection timings according to the moving speed of the printing head. As a result, a high-grade image can be printed without being affected by a variation in moving speed of the printing head.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Figure 6:
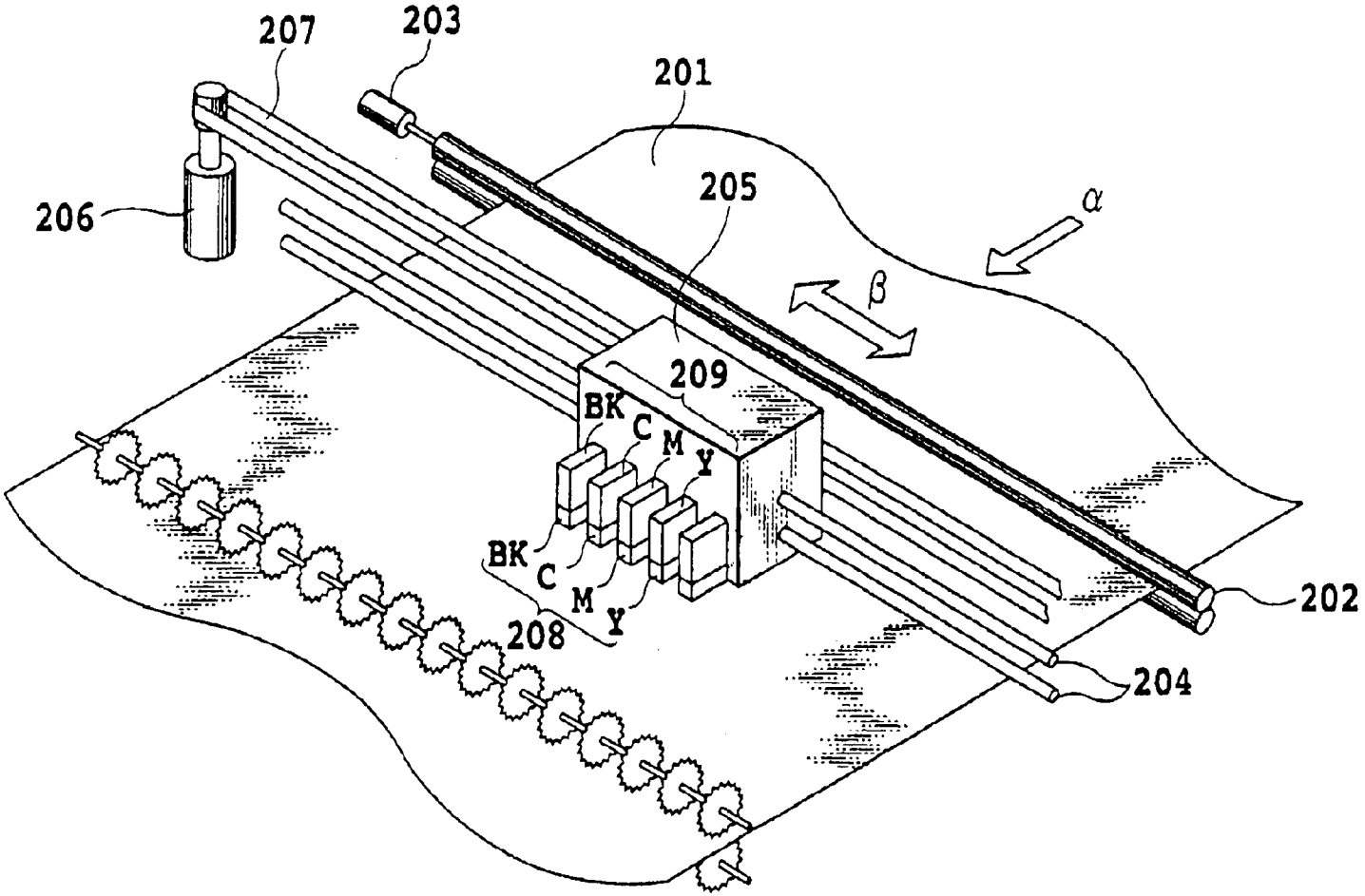
FIG. 6 is a perspective view of an essential portion of a mechanically constructed part of an ink jet printing apparatus to which the present invention is applicable.
Figure 7:
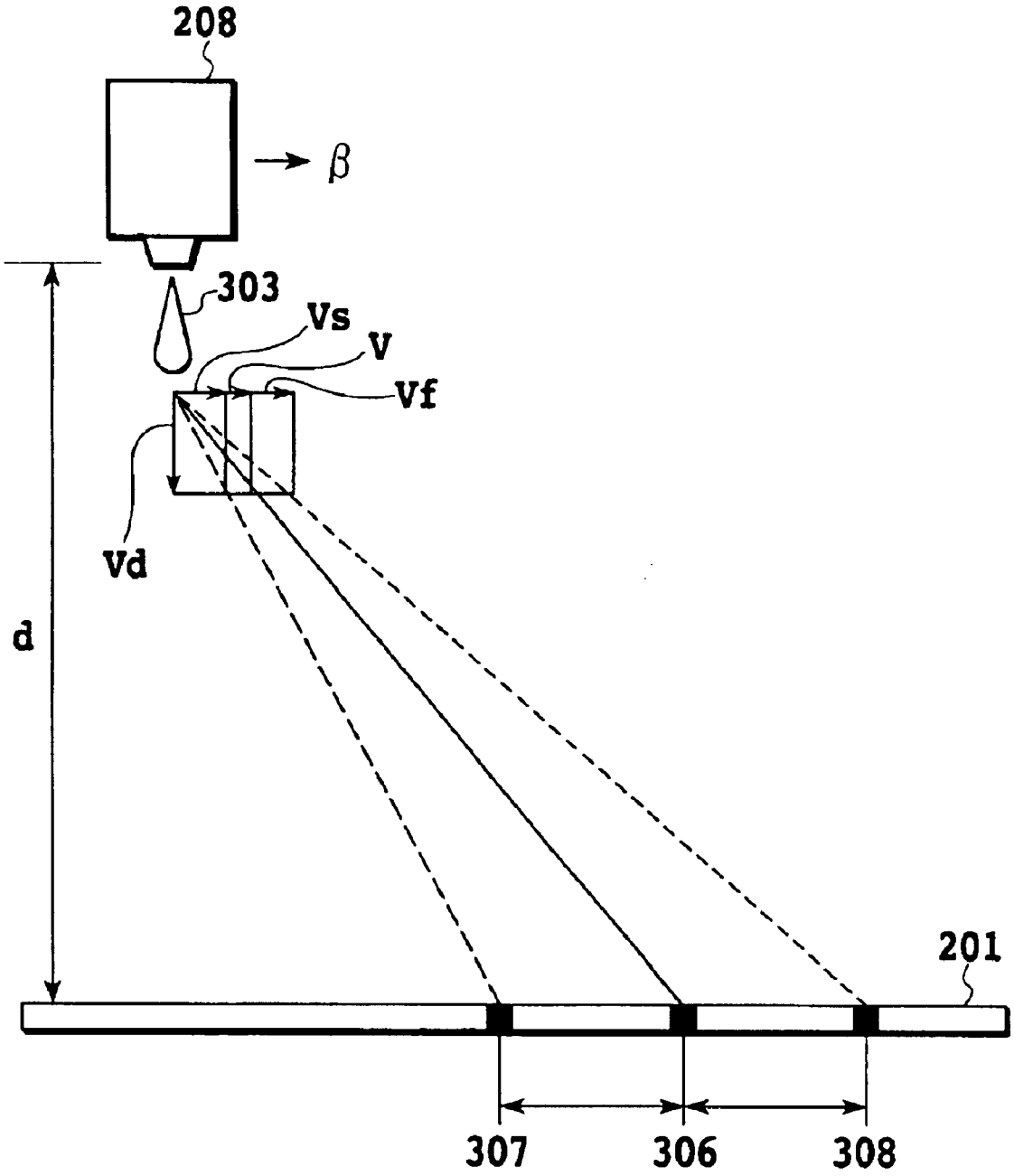
FIG. 7 is a diagram illustrating the relationship between the moving speed of a printing head of the ink jet printing apparatus in FIG. 6 and the ink droplet impacting position.

An embodiment of the present invention will be described below with reference to the drawings. The mechanical construction of a printing apparatus in this example is similar to that of the conventional example in FIG. 6, described previously.

Figure 1:
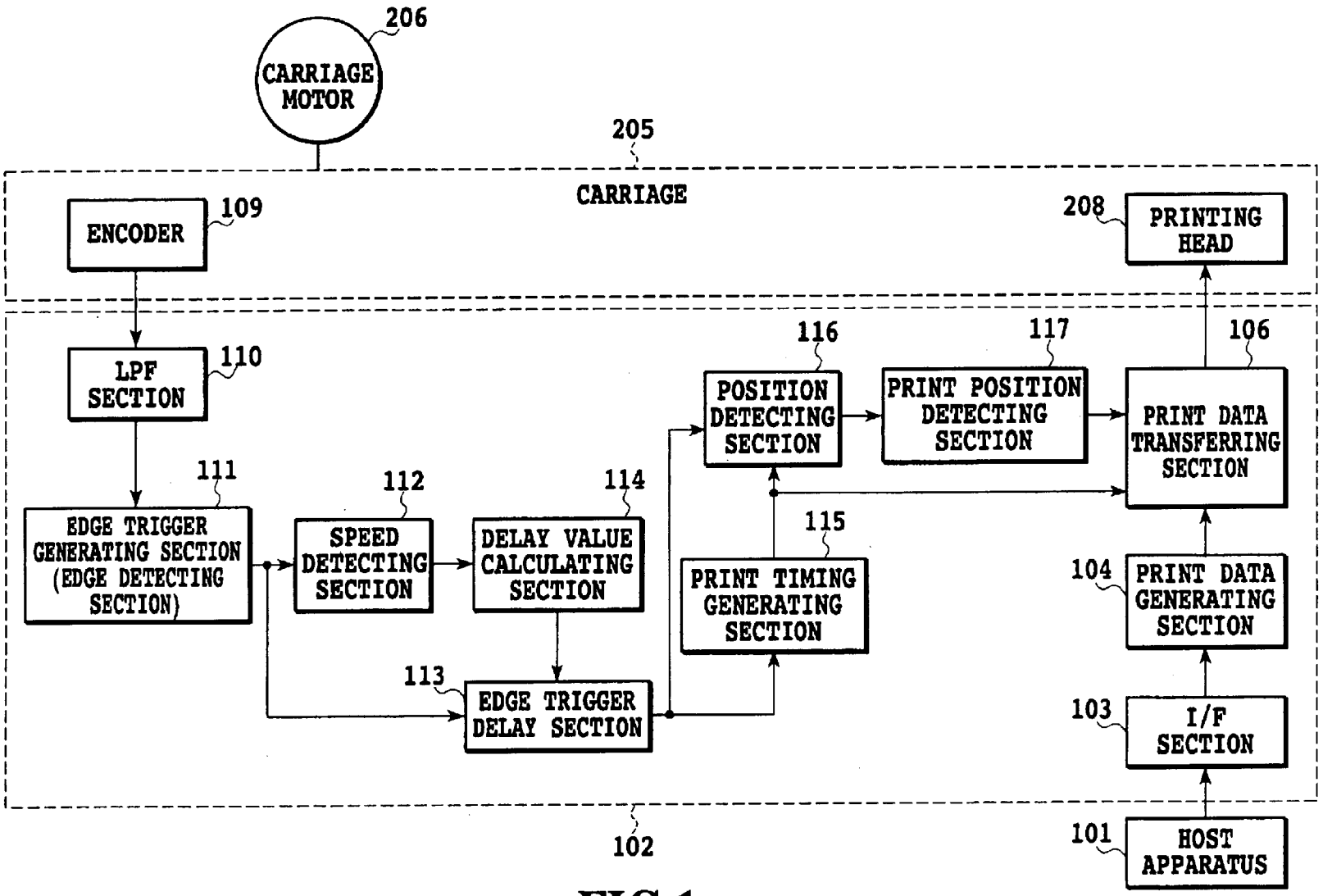
FIG. 1 is a block diagram of an essential part of a control system of an ink jet printing apparatus according to the present invention.

FIG. 1 is a block diagram of the printing apparatus in this example.

Print data transferred from a host apparatus 101 is received by an I/F section 103 in a print control section 102 of the printing apparatus in this example and is then transmitted to a print data generating section 104. The print data generating section 104 carries out decompression of compressed data, conversion of a data arrangement, and the like to convert the received data into a format that can be printed by a printing head 208. The printing head 208 may be, for example, an ink jet printing head of a type that ejects ink using thermal energy. The ink jet printing head causes film boiling in ink in an ink channel using thermal energy generated by an electrothermal converter provided in the ink channel. The resulting bubbling energy is used to eject an ink droplet through an ink ejecting port.

On the other hand, a carriage 205 driven by a carriage motor 206 has the printing head 208 and an encoder 109 mounted thereon. The encoder 109 outputs a pulse signal each time the carriage 205 is moved a specified distance. A pulse signal generated by the encoder 109 passes through an LPF section 110 in a print control section 102. In the LPF section 110, the pulse signal is deprived of noise and then transmitted to an edge trigger generating section 111. The edge trigger generating section 111 detects predetermined edges (encoder edges) in the received pulse signal to generate trigger pulses. The trigger pulses generated by the edge trigger generating section 111 are transmitted to a speed detecting section 112 and an edge trigger delay section 113. The speed detecting section 112 measures the interval between the trigger pulses generated by the edge trigger generating section 111, and transfers the corresponding value to a delay value calculating section 114 as the current speed information. Further, the speed information detected by the speed detecting section 112 is also transmitted to a servo controller (not shown) that servo-controls the carriage motor 206, as required.

The delay value calculating section 114 uses the current speed information and the like transmitted by the speed detecting section 112 to calculate an impact correction delay value required to correct the ink droplet impacting position as described later. The edge trigger delay section 113 delays the trigger pulses generated by the edge trigger generating section 111 according to the impact correction delay value calculated by the delay value calculating section 114. Then, the edge trigger delay section 113 outputs the trigger pulses to a print timing generating section 115. The print timing generating section 115 generates a print timing signal by converting the trigger pulses transmitted by the edge trigger delay section 113 into print resolutions. Then, the print timing generating section 115 transmits the print timing signal to a print data transferring section 106 and a position detecting section 116. The position detecting section 116 uses an up/down counter to count the signals transmitted from the edge trigger delay section 113 and print timing generating section 115, thereby detecting the moving position of the carriage 205. The position information detected by the position detecting section 116 is transmitted to a print position detecting section 117. The print position detecting section 117 generates a print start signal when a print start position is detected in the position information, while generating a print end signal when a print end position is detected therein. Then, the print position detecting section 117 transmits this signal to the print data transferring section 106. The print data transferring section 106 transfers print data generated by the print data generating section 104 to the printing head 208 according to the information from the print timing generating section 115 and print position detecting section 117. On the basis of the information transmitted from the print data transferring section 106, the printing head 208 ejects the ink droplet to the printing medium 201.

Figure 2:
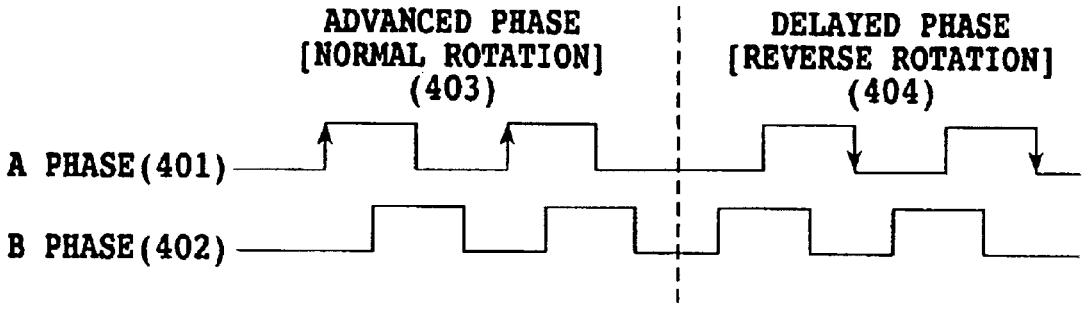
FIG. 2 is a diagram illustrating output signals from an encoder in FIG. 1.

FIG. 2 shows the waveforms of signals (encoder signals) generated by the encoder 109.

Signals generated by the encoder 109 have two waveforms with an A phase 401 and a B phase 402 which deviate from each other through about 90° as in the case with general digital encoder signals. Thus, an advanced phase (normal rotation) 403, shown in the left of FIG. 2, or a delayed phase (reverse rotation) 404, shown in the right of FIG. 2, is obtained depending on the movement direction of the carriage 205. Accordingly, the moving position of the carriage 205 can be detected by, for example, using one-side edges of the A phase as detected points to switch an up/down operation of a position detecting counter at rising and falling edges of the A phase with the B phase fixed at a certain level (in the figure, a low level). More specifically, for example, with the B phase at the low level, the up/down operation of the position detecting counter is switched so that the position detecting counter performs a count up operation each time a rising edge is detected in the A phase, whereas it performs a count down operation each time a falling edge is detected. Then, the moving position of the carriage 205 (the moving position of the printing head 208) can be detected from the count value of the position detecting counter.

The edge trigger generating section 111 detects edges of encoder pulses as shown in FIG. 2 to generate trigger pulses. The speed detecting section 112 measures the interval (time) (also referred to as the "encoder edge interval (time)") between the trigger pulses to detect the moving speed of the carriage 205.

Figure 3:
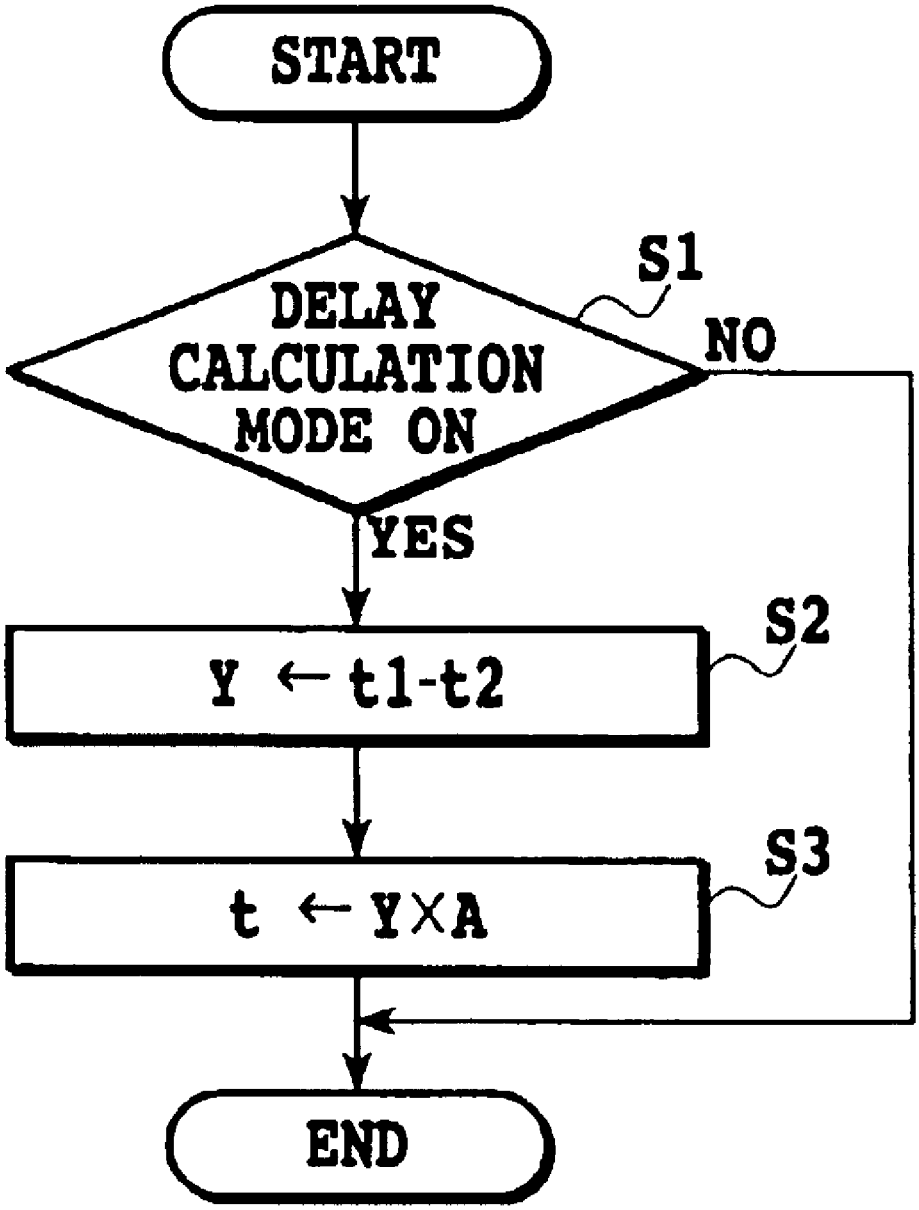
FIG. 3 is a flow chart illustrating a basic calculating operation performed by a delay value calculating section in FIG. 1.

FIG. 3 is a flow chart illustrating a basic calculating operation performed by the delay value calculating section 114.

In FIG. 3, t1 denotes the current encoder edge interval (time), which corresponds to the current speed of the carriage 205 (the current speed of the printing head 208). t2 denotes the encoder edge interval (time) at the expected maximum speed, which corresponds to the maximum speed of the carriage 205 (the maximum speed of the printing head 208). Y denotes the result of the calculation (t1−t2), and A denotes the constant of the value (t3/t2). t3 denotes the time required for the ink droplet 303 ejected from the printing head 208 to impact the printing medium 201. t denotes an impact correction delay value as the result of a calculation executed by the delay value calculating section 114.

In this case, the expected maximum speed is a virtual speed which is higher than a speed achieved by scanning of the carriage. It is advantageous to set the maximum speed to be higher than the speed achieved by scanning of the carriage. However, the delay value increases as the maximum speed is set to be higher. Therefore, if the set maximum speed is too high, the delay value exceeds one period of the encoder signal, thus requiring a circuit and the like which holds the delay value until the next period of the encoder signal. Accordingly, it is desirable that the maximum speed be higher than the speed achieved by scanning of the carriage, and be set within the range such that the delay value does not exceed one period of the encoder signal.

First, after a calculation has been started, it is checked whether a delay calculation mode is ON or OFF (S1). If this mode is OFF, the calculation is ended. If the mode is ON, the calculation is continued When the delay calculation mode is ON, the calculation (t1−t2) is executed to determine the value Y (S2). Then, the calculation (Y×A) is executed to determine the impact correction delay value t (S3). Accordingly, an operational expression for the impact correction delay value t in FIG. 3 is shown below.

$$t=(t1-t2)\times A \tag{1}$$

The value t decreases with increasing current speed of the carriage 205 and consistently with the encoder edge interval t1. Conversely, the value t increases with decreasing current speed of the carriage 205 and consistently with the encoder edge interval t1.

Figure 4:
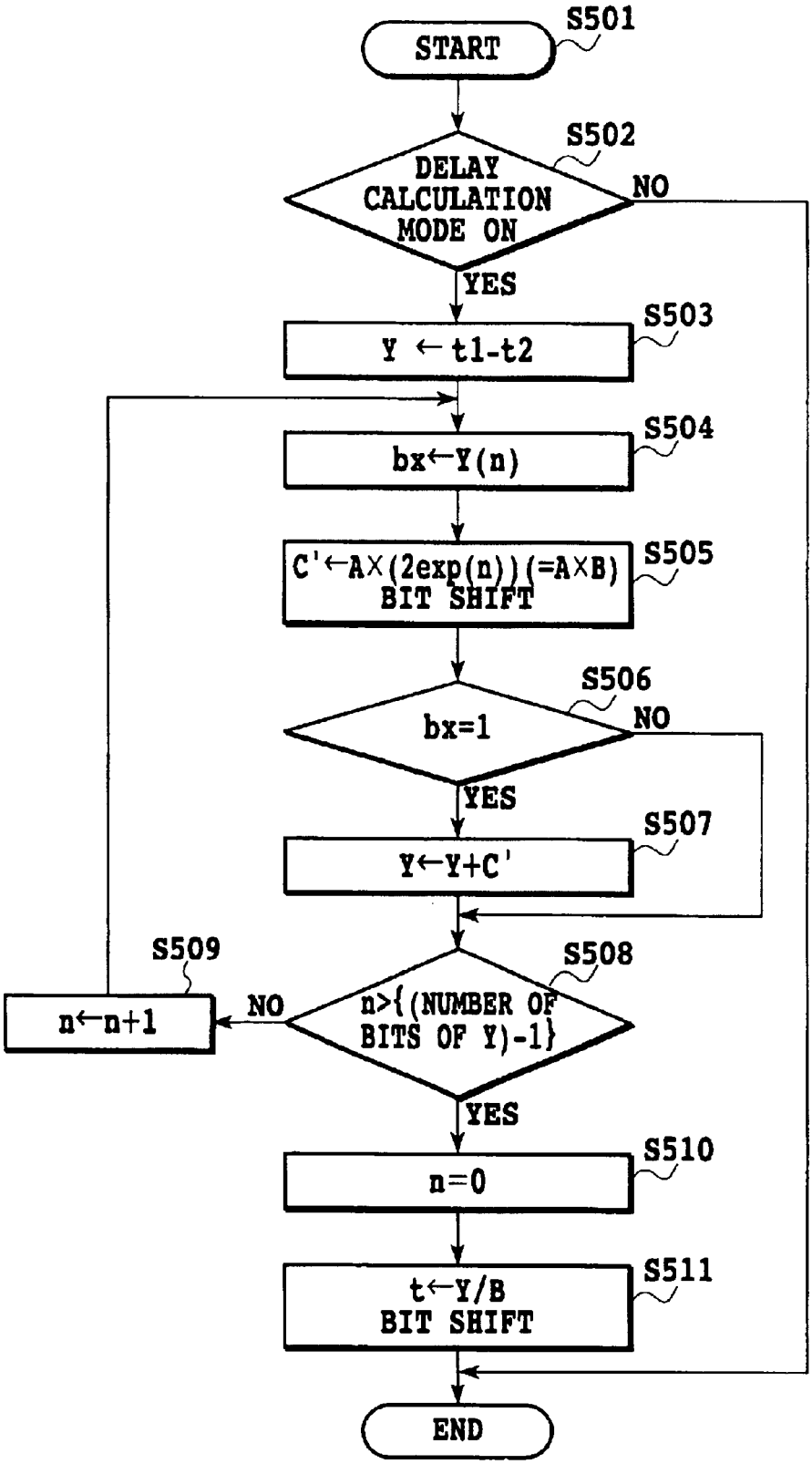
FIG. 4 is a flow chart illustrating a more specific calculating operation performed by the delay value calculating section in FIG. 1.

FIG. 4 is a flow chart illustrating a more specific calculating operation performed by the delay value calculating section 114.

In FIG. 4, a constant C containing B (the power of 2) is used in place of the constant A (=t3/t2). That is, the constant C is set as a fixed value by calculating (A×B). Consequently, C=A×B=(t3/t2)×B. An operational expression for the impact compression delay value t is shown below.

$$t=\{(t1-t2)\times C\}/B \tag{2}$$

Further, Y(n) in FIG. 4 is the value of the n-th bit of the value Y as expressed by binary notation.

First, after a calculation has been started (S501), it is checked whether the delay calculation mode is ON or OFF (S502). If this mode is OFF, the calculation is ended. If the mode is ON, the calculation is continued. When the delay calculation mode is ON, the calculation (t1−t2) is executed to determine the value Y (S503). Then, the n-th bit of the value Y (at the first time, n−0) is recognized as bx (S504). Further, n "0"s (at the first time, n=0) are added to the value C as expressed by binary notation, at the least significant positions. That is, the value C as expressed by binary notation is shifted by n bits to obtain a value C' (C505). At the first time, n=0, so that C=C'. Subsequently, it is determined whether or not the value bx is 1 (S506), the value Y is corrected to the value (Y+C') when bx=1 (S507). The value Y remains unchanged when bx=0. At the first time, bx=0, so that the value Y remains unchanged.

Then, it is determined whether or not the value n exceeds {(the number of bits of the value Y)−1} (S508). If the result of the determination is negative, the value n is increased to (n+1) (S509), and the process returns to step S504. Thus, steps S504 to S507 are repeated until the value n reaches {(the number of bits of the value Y)−1}. The number of the repetitions equals the number of bits of the value Y.

During the second repetition of steps S504 to S507, the value n changes from 0 to 1, and the first bit of the value Y is recognized as bx (S504). Further, one "0" is added to the value C as expressed by binary notation, at the least significant position, i.e., the value C is shifted by one bit to obtain a value C' (S505). Accordingly, the value C' is obtained by doubling the value C (×2). Subsequently, it is determined whether or not the value bx is 1 (S506). When bx=1, the value Y is corrected to (Y+C') (S507). When bx=0, the value Y remains unchanged.

Similarly, steps S504 to S507 are repeated as many times as the number of bits of the value Y. Then, the value n is reset to 0 (S510), and the calculation (Y/B) is executed to determine the impact correction delay value t (S511). Since the value B is the power of 2, the least significant bits of the value Y as expressed by binary notation may actually be rounded off by bit shifting. As a result, the impact correction delay value t is determined by Equation (2), shown above.

As described above, the impact correction delay value t, calculated by the delay value calculating section 114, is transmitted to the edge trigger delay section 113 (see FIG. 1). Then, print timings are adjusted according to the impact correction delay value t.

Figure 5:
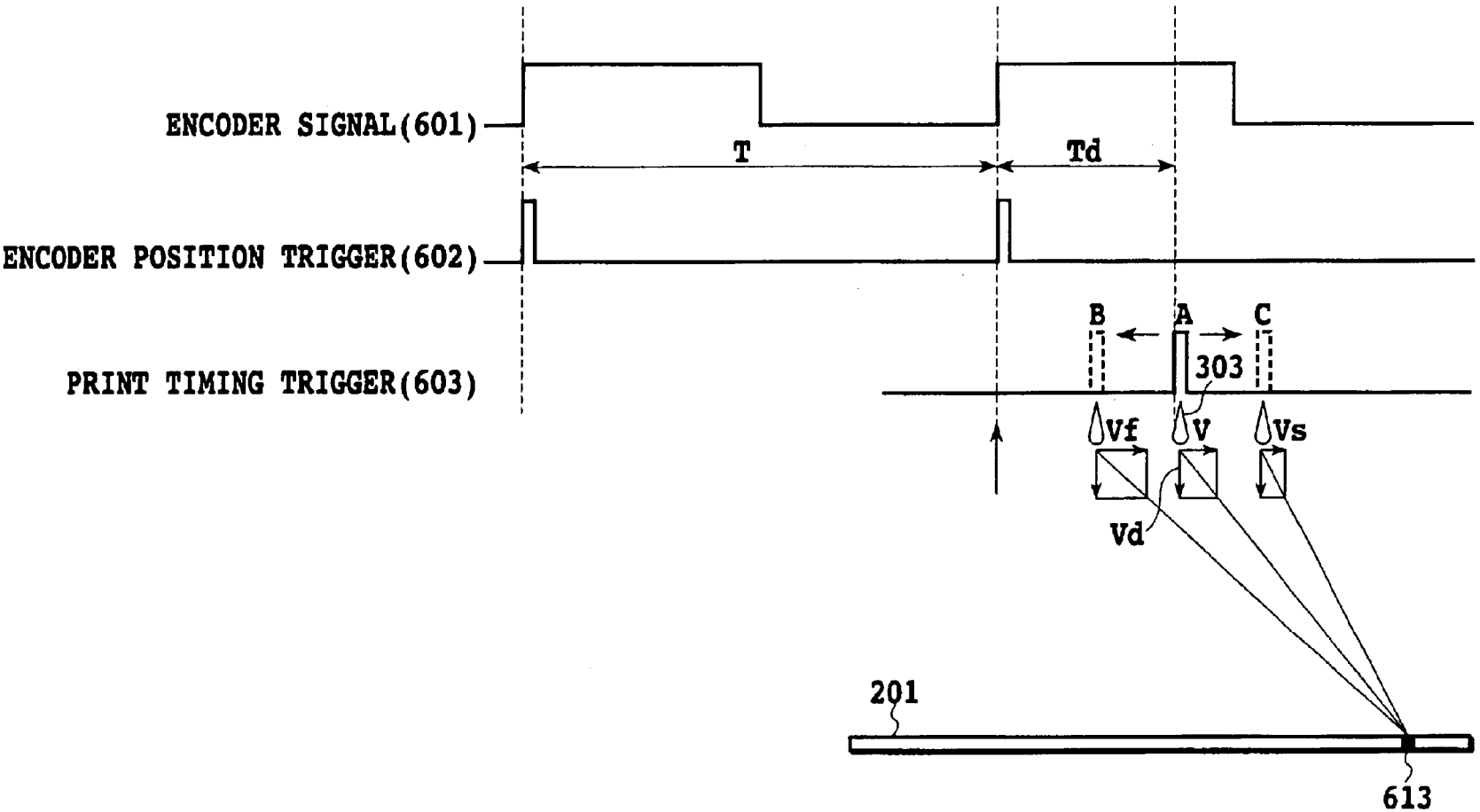
FIG. 5 is a diagram illustrating the relationship between print timings for the ink jet printing apparatus in FIG. 1 and an ink droplet impacting position.

FIG. 5 is a diagram illustrating the relationship between print timings and an ink droplet impacting position.

The edge trigger generating section 111 (see FIG. 1) uses an encoder signal 601 to generate an encoder position trigger 602 as a position management signal for the printing head 208. If high-resolution printing is carried out, triggers are generated which have a period equal to half or quarter the period of the encoder signal. For example, if the period of the encoder signal corresponds to a resolution of 300 dpi, a print resolution of 600 dpi is obtained using triggers having a period equal to half the period of the encoder signal. Further, a print resolution of 1,200 dpi is obtained using triggers having a period equal to quarter the period of the encoder signal. In FIG. 5, for simplification of the description, it is assumed that a printing operation is performed with a resolution corresponding to the period of the encoder signal 601. That is, the number of encoder position triggers 602 equals the number of print timing triggers 603 generated by the edge trigger delay section 113.

In this case, the ink droplet 303 flies in the direction of a vector obtained by synthesizing the vector of the moving speed of the printing head 208 (the moving speed of the carriage 205) with the vector of the speed at which the ink droplet 303 is elected. When the printing head 208, which ejects the ink droplet 303 at a speed Vd, is moved at an ideal speed V, the edge trigger delay section 113 generates a print timing trigger A using a delay value Td. In this case, when the current speed of the printing head 208 is Vf, which is higher than the ideal speed V, the delay value calculating section 114 calculates a smaller impact correction delay value t. The delay value Td correspondingly decreases. Consequently, at this time, a print timing trigger B is generated earlier than the print timing trigger A generated at the ideal speed V. On the other hand, when the current speed of the printing head 208 is Vs, which is lower than the ideal speed V, the delay value calculating section 114 calculates a larger impact correction delay value t. The delay value Td correspondingly increases. Consequently, at this time, a print timing trigger C is generated later than the print timing trigger A generated at the ideal speed V.

By thus controlling the occurrence timing for the print timing trigger 603, the deviation of the impacting position of the ink droplet 303, attributed to a variation in moving speed of the printing head 208, is corrected to enable the ink droplet 303 to always impact the printing medium at the impacting position 613, which is obtained when the printing head 208 is moved at the ideal speed. In the calculation, the current moving speed of the printing head 208 (the current moving speed of the carriage 205) is the inverse of the period T of the encoder signal 601 corresponding to the position immediately before the current one.

Other Embodiments

In the present invention, it is possible to carry out not only unidirectional printing in which a printing operation is performed only when the printing head is moved in one direction but also bi-directional printing in which a printing operation is performed when the printing head is moved in both directions.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus using a printing head capable of ejecting ink and printing on a printing medium by ejecting ink while moving at least one of the printing head and the printing medium relative to the other, said apparatus comprising:

an encoder that outputs a pulse each time at least one of the printing head and the printing medium is moved a specified amount relative to the other;

detecting means for detecting a time interval between the pulses;

adjusting means capable of adjusting driving timings with which the ink is ejected from the printing head;

calculating means for setting the time interval between the pulses obtained when at least one of the printing head and the printing medium is moved relative to the other with an expected relatively high reference speed as a reference time interval, and calculating a delay time for a driving timing for the printing head depending on the magnitude of a difference between the time interval between the pulses detected by said detecting means and the reference time interval; and control means for controlling said adjusting means depending on the delay time calculated by said calculating means.

2. An ink jet printing apparatus as claimed in claim 1, wherein said detecting means detects the time interval between edges of the pulses.

3. An ink jet printing apparatus as claimed in claim 1, wherein when the time interval between the pulses detected by said detecting means is defined as t1, the reference time interval is defined as t2, and time required for the ink ejected from the printing head to reach the printing medium is defined as t3, said calculating means calculates the delay time t for the driving timing for the printing head using the following equations:

$$A=t3/t2$$

$$t=(t1-t2)*A.$$

4. An ink jet printing apparatus as claimed in claim 3, wherein said calculating means sets a constant C (=A*B) by setting a value B as the power of 2, and calculates the delay time t for the driving timing for the printing head using the following equation:

$$t=((t1-t2)*C)/B.$$

5. An ink jet printing apparatus as claimed in claim 1, wherein a reciprocating printing operation is performed by ejecting the ink from the printing head while reciprocating the printing head relative to the printing medium.

6. An ink jet printing apparatus as claimed in claim 1, further comprising:

first movement means for moving at least one of the printing head and the printing medium relative to the other in a main scanning direction; and second movement means for moving at least one of the printing head and the printing medium relative to the other in a sub-scanning direction transverse to the main scanning direction.

7. An ink jet printing apparatus as claimed in claim 1, wherein the printing head comprises an electrothermal converter that generates thermal energy used to eject ink.

8. An ink-jet printing apparatus as claimed in claim 1, wherein said calculating means calculates the delay time by using a time difference and a time ratio, the time difference being a difference between the reference time interval and the time interval between the pulses detected by said detecting means, and the time ratio being a ratio between the reference time interval and time required for the ink ejected from the printing head to reach the printing medium.

9. An ink jet printing method of using a printing head capable of ejecting ink and printing on a printing medium by ejecting ink while moving at least one of the printing head and the printing medium relative to the other, said method comprising the steps of:

using an encoder that outputs a pulse each time at least one of the printing head and the printing medium is moved a specified amount relative to the other;

setting a time interval between the pulses obtained when at least one of the printing head and the printing medium is moved relative to the other with an expected relatively high reference speed as a reference time interval, and calculating a delay time for a driving timing for the printing head depending on the magnitude of a difference between the time interval between the pulses and the reference time interval; and adjusting the driving timing with which the ink is ejected from the printing head, depending on the delay time.

10. An ink jet printing apparatus using a printing head capable of ejecting ink and printing on a printing medium by ejecting ink while moving at least one of the printing head and the printing medium relative to the other, said apparatus comprising:

an encoder that outputs a pulse each time at least one of the printing head and the printing medium is moved a specified amount relative to the other;

detecting means for detecting a time interval between the pulses;

adjusting means capable of adjusting driving timings with which the ink is ejected from the printing head;

calculating means for calculating a delay time for a driving timing for the printing head depending on the magnitude of a difference between the time interval between the pulses detected by said detecting means and a reference time interval between the pulses obtained when at least one of the printing head and the printing medium is moved relative to the other with an expected relatively high reference speed; and control means for controlling said adjusting means depending on the delay time calculated by said calculating means.

11. An ink jet printing apparatus as claimed in claim 10, wherein said detecting means detects the time interval between edges of the pulses.

12. An ink jet printing apparatus as claimed in claim 10, wherein when the time interval between the pulses detected by said detecting means is defined as t1, the reference time interval is defined as t2, and time required for the ink ejected from the printing head to reach the printing medium is defined as t3, said calculating means calculates the delay time t for the driving timing for the printing head using the following equations:

$$A=t3/t2$$

$$t=(t1-t2)*A.$$

13. An ink jet printing apparatus as claimed in claim 12, wherein said calculating means sets a constant C (=A*B) by setting a value B as the power of 2, and calculates the delay time t for the driving timing for the printing head using the following equation:

$$t=((t1-t2)*C)/B.$$

14. An ink-jet printing apparatus as claimed in claim 10, wherein said calculating means calculates the delay time by using a time difference and a time ratio, the time difference being a difference between the reference time interval and the time interval between the pulses detected by said detecting means, and the time ratio being a ratio between the reference time interval and time required for the ink ejected from the printing head to reach the printing medium.

15. An ink jet printing method using a printing head capable of ejecting ink and printing on a printing medium by ejecting ink while moving at least one of the printing head and the printing medium relative to the other, said method comprising the steps of:

using an encoder that outputs a pulse each time at least one of the printing head and the printing medium is moved a specified amount relative to the other;

detecting a time interval between the pulses;

adjusting driving timings with which the ink is ejected from the printing head;

calculating a delay time for a driving timing for the printing head depending on the magnitude of a difference between the time interval between the pulses detected in said detecting step and a reference time interval between the pulses obtained when at least one of the printing head and the printing medium is moved relative to the other with an expected relatively high reference speed; and controlling adjustment of the driving timings depending on the delay time calculated in said calculating step.

* * * * *

UNITED STATES PATENT AND TRADEMARK OFFICE

CERTIFICATE OF CORRECTION

PATENT NO. : 6,910,752 B2
DATED : June 28, 2005
INVENTOR(S) : Shoji

It is certified that error appears in the above-identified patent and that said Letters Patent is hereby corrected as shown below:

Column 1,
Line 9, “BACKGROUD” should read -- BACKGROUND --.

Column 3,
Line 10, “comprising;” should read -- comprising: --.

Column 6,
Line 20, “continued” should read -- continued. --.
Line 51, “n–0)” should read -- n=0) --.

Column 7,
Line 47, “elected.” should read -- ejected --.

Column 9,
Line 22, “ink-jet” should read -- ink jet --.

Column 10,
Line 33, “ink-jet” should read -- ink jet --.

Signed and Sealed this

Ninth Day of May, 2006

JON W. DUDAS
*Director of the United States Patent and Trademark Office*